US006412253B1

(12) United States Patent
Meyer et al.

(10) Patent No.: US 6,412,253 B1
(45) Date of Patent: Jul. 2, 2002

(54) BAG-BOXING APPARATUS AND METHOD

(75) Inventors: Armin Meyer, Köln; Manfred Papsch, Niederkassel, both of (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 81 days.

(21) Appl. No.: 09/651,573

(22) Filed: Aug. 25, 2000

(30) Foreign Application Priority Data

Aug. 26, 1999 (DE) ..... 199 40 637

(51) Int. Cl.[7] ..... B65B 63/04

(52) U.S. Cl. ..... 53/399; 53/429; 53/473; 53/116; 53/235; 294/103.1

(58) Field of Search ..... 53/399, 429, 447, 53/449, 473, 475, 116, 120, 531, 176, 235; 294/103.1, 119.1

(56) References Cited

U.S. PATENT DOCUMENTS 3,640,050 A 2/1972 Nystrand et al.
3,919,827 A * 11/1975 Larson et al. ..... 53/429
4,588,070 A 5/1986 Smith
5,042,862 A * 8/1991 Tubke ..... 294/103.1
5,056,202 A 10/1991 Stiegler
5,185,987 A 2/1993 Turvey et al.
5,391,050 A * 2/1995 Gatteschi ..... 294/119.1
6,082,797 A * 7/2000 Antonette ..... 294/103.1

FOREIGN PATENT DOCUMENTS

DE 38 34 115 5/1990

* cited by examiner

*Primary Examiner*—Stephen F. Gerrity
(74) *Attorney, Agent, or Firm*—Herbert Dubno; Andrew Wilford

(57) ABSTRACT

A stack of flexible bags oriented horizontally in a stack station is packaged by first sliding a robot hand horizontally into position around an end portion of the stack with front and rear grabs of the hand aligned with edges of the end portion and another portion of the stack wholly outside the hand. Then the grabs are closed on the edges of the end portion with the front grab positioned inward of the stack from the back grab and the hand is raised and pivoted about a horizontal axis to fold the gripped stack about a fold line adjacent the front grab and to one side of which lies the gripped portion and to the other side of which lies the other portion so that the bag is given a downwardly open U-shape. The back grab is then released and reengaged around the folded stack to press the other portion against the end portion still gripped by the front grab. Then the hand is pivoted into a position with the folded and gripped stack oriented horizontally and the folded and gripped stack is positioned in an upwardly open container. The grabs are released and the hand is lifted out of the container to leave the folded stack therein.

10 Claims, 6 Drawing Sheets

BAG-BOXING APPARATUS AND METHOD

FIELD OF THE INVENTION

The present invention relates to a bag-boxing apparatus. More particularly this invention concerns a machine that takes a stack of flexible bags or the like from a stacking station, folds the stack, and places the stack in a box for shipment or further handling.

BACKGROUND OF THE INVENTION

Bags, typically of plastic, are produced one after the other from a plastic tube and are formed into stacks at the end of the bag-production line. These stacks must be placed into some sort of container, normally a shipping carton, to which end the stack must be folded in half for most efficient packaging, as otherwise the package would be too large.

U.S. Pat. No. 3,640,050 of Nystrand discloses such a device where the stack of bags is first set atop a downwardly V-shaped folding plate so that the stack forms a downwardly open U-shape. This U-shaped stack is then gripped, flipped on its side, and pushed between a pair of folding blocks to produce a double fold in the stack. The patent is silent as to how the stack is held during the various picking-up, reorienting, and folding operations.

In U.S. Pat. No. 4,588,070 of Smith a bag-transfer device is described having a pair of grippers that can be set at different spacings to hold bags of different sizes. There is no discussion of how to use such a two-part gripper in a bag-boxing apparatus.

U.S. Pat. No. 4,056,202 of Steigler handles a stack of bags pinned together by a large holding staple that forms wicketing pins during the stacking operation and that subsequently is what is grabbed to move the stack of bags. This disclosure is also silent about any folding and boxing operation.

The transfer apparatus disclosed in U.S. Pat. No. 5,185,987 of Turvey has a system for folding a stack of flexible sheets and tucking the stack, fold-side first, into the jaws of a carousel-like transport device which then sweeps them over a slide so as to form a second fold, whereupon the twice-folded stack is stuffed into a container. This arrangement is fairly complex and is not readily adaptable to sheets of different sizes.

OBJECTS OF THE INVENTION

It is therefore an object of the present invention to provide an improved bag-packing system.

Another object is the provision of an improved bag-packing method which overcomes the above-given disadvantages, that is which surely and accurately picks up a stack of bags, folds it in half, and puts the folded stack into a container.

A further object is to provide an improved apparatus for carrying out the method.

SUMMARY OF THE INVENTION

A stack of flexible bags oriented horizontally in a stack station is packaged by first sliding a robot hand horizontally into position around an end portion of the stack with front and rear grabs of the hand aligned with edges of the end portion and another portion of the stack wholly outside the hand. Then the grabs are closed on the edges of the end portion with the front grab positioned inward of the stack from the back grab and the hand is raised and pivoted about a horizontal axis to fold the gripped stack about a fold line adjacent the front grab and to one side of which lies the gripped portion and to the other side of which lies the other portion so that the bag is given a downwardly open U-shape. The back grab is then released and reengaged around the folded stack to press the other portion against the end portion still gripped by the front grab. Then the hand is pivoted into a position with the folded and gripped stack oriented horizontally and the folded and gripped stack is positioned in an upwardly open container. The grabs are released and the hand is lifted out of the container to leave the folded stack therein.

Thus the system of this invention works extremely smoothly and can easily be used for bags of different lengths. It folds the bag stack with a simple movement and then deposits the folded stack into the container.

According to one procedure of this invention after forming the fold, the folded stack is set atop a fold plate and the front grab is released from the folded stack. Then the hand is raised, oriented with one of the grabs above the other, and then lowered it down over the folded stack on the fold plate. The hand thus makes three simple movements, a first one picking up the stack, forming the fold, and setting it on the fold plate, a second moving clear of the folded stack on the plate, and a third picking it up off the plate and setting it in the container. Such operation is very easy to program into standard industrial robot.

According to another feature of the invention after forming the fold the hand is pivoted sufficiently that the other portion comes to lie against the one portion held by the grab. Then the front grab is retracted from between the portions of the folded stack and reorienting outside the portions. Thereafter the front grab, as before, is brought back to clamp the folded stack in place. This system dispenses with the folding plate and allows the operation to be reduced to two sweeping movements of the hand, one picking up the stack and pivoting it back until it folds and the fold is captured and another pivoting back down and depositing the stack in the container.

In fact the stack can be formed into a multiple or Z-fold by closing the front grab on both portions of the folded bag while leaving an outer portion of the stack hanging from the front grab, pivoting the hand backward until the outer portion comes to lie against the outer portion of the folded stack, retracting the rear grab from between the end and other portions and engaging it back against the outer portion to press same against the end and other portions. This can be repeated as much as necessary to form a stack with as many folds as desired.

The folded stack is pushed down out of the hand into the container by a knockout device that can be carried on the hand. Furthermore it is possible to wrap a band around the folded stack.

The apparatus for packaging a stack of flexible bags oriented horizontally in a stack station has according to the invention a robot hand having front and rear grabs engageable with edges of an end portion of the stack with another portion of the stack wholly outside the hand, and control means for carrying out the above-detailed steps. The grabs are each formed by two pairs of jaws. The jaws of the front grab is operable independently of the jaws of the back grab. For the multiple-folding system means is provided for displacing one of the pairs of jaws of each grab away from the other of the pairs of jaws of the respective grab.

BRIEF DESCRIPTION OF THE DRAWING

The above and other objects, features, and advantages will become more readily apparent from the following description, reference being made to the accompanying drawing in which.

SPECIFIC DESCRIPTION

Figure 4:
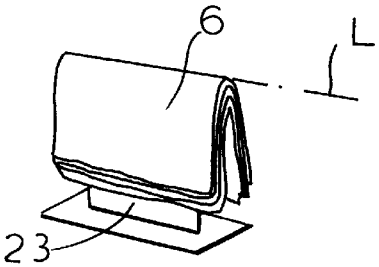
Figure 5:
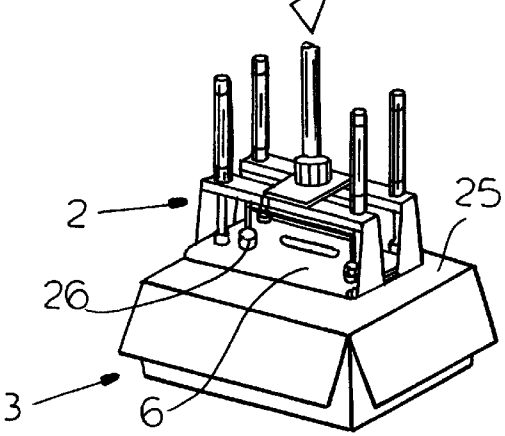
Figure 6:
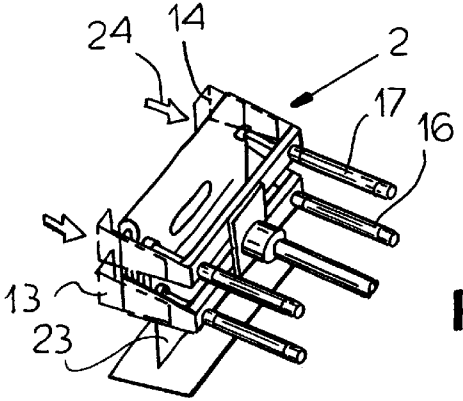

As seen in FIGS. 1 through 6 a robot 1 operated by an electronic controller 12 has a complex hand 2 adapted to pick a stack 6 of polyethylene shopping bags off a support plate 7 in a stacking station 2 (FIG. 1), fold the stack 6 in half, and deposit the folded stack 6 into a box 25 at a packaging station 3 (FIG. 6). The support plate 7 can be pivoted about a horizontal axis and is provided with one or more wicket pins 5 extending through hole 8 formed in the stack 6 by aligned hand holes of the bags forming the stack 6.

The robot hand 2 is carried on the end of an arm 10 and comprises back and front grabs 9 and 11 The front grab 9 is comprised of a central strut 13' carrying a pair of L-shaped outer jaws 13 and a pair of inner jaws 16. The back grab 11 is comprised of a central strut 14' carrying a similar pair of L-shaped outer jaws 14 and a pair of inner jaws 17. The jaws 13 and 16 of the grab 9 and the jaws 14 and 17 of the grab 11 are spaced apart transversely relative to a horizontal starting direction 18 so they can grip edges of the stack 6.

Figure 1:
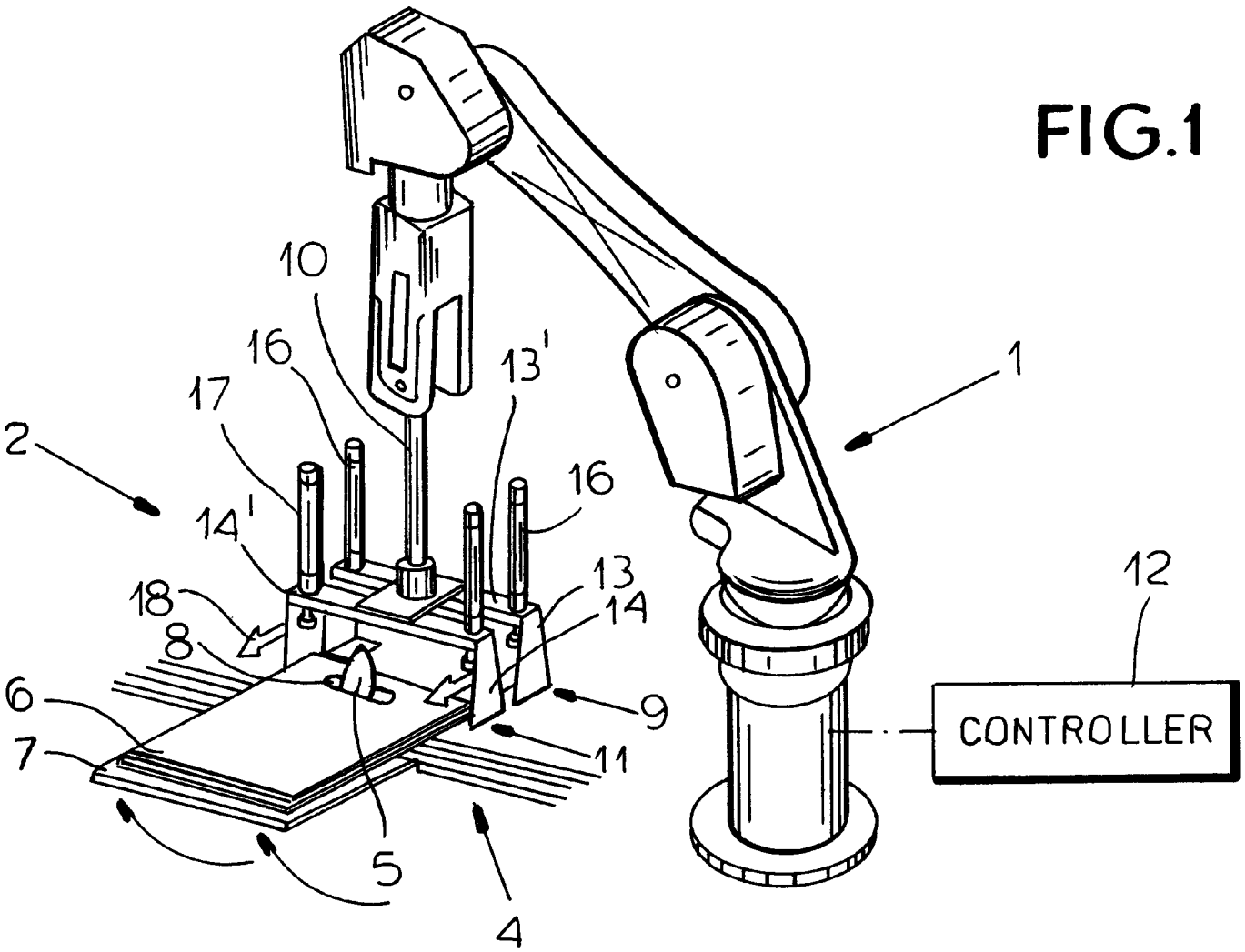
FIGS. 1 through 6 are small-scale and partly diagrammatic views illustrating a bag-boxing method and apparatus according to the invention.
Figure 2:
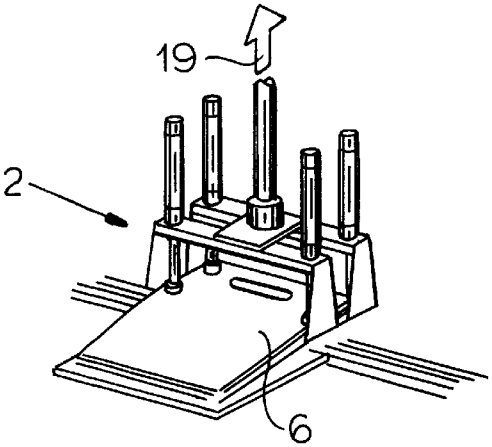

As shown in FIG. 1 initially the hand 2 is moved horizontally and longitudinally of the bag stack 6 in the direction 18 with the grabs 9 and 11 open. Once in position, with the front jaws 11 just short of the center of the stack 6, the inner jaws 16 and 17 are brought down to grip the bag stack 6 as shown in FIG. 2 and the hand 2 is lifted as indicated by vertical direction arrow 19 to raise stack 6 off the plate 7.

Figure 3:
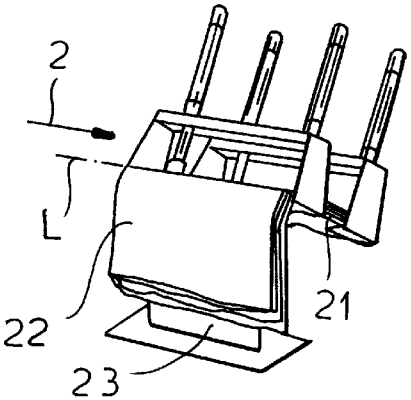

Then as shown in FIG. 3 the hand 2 is pivoted about a horizontal axis perpendicular to the direction 18 so that the stack 6 folds along a generally central line L between a portion 21 gripped by the hand 2 and a portion 22 hanging down from the hand 2. The partially folded bag stack 21, 22 is then moved over a vertical folding plate 23 and is set down on it and released by the hand 2 as shown in FIG. 4.

As shown in FIG. 5 the hand 2, with its grabs 9 and 11 wide open, is then shifted vertically down over the folded stack hanging on the plate 23 as shown in FIG. 5 and the hand 2 is moved somewhat horizontally as indicated by arrow 24 while the jaws 16 and 17 are extended to grip the folded stack on the plate 23 at its edges between the grabs 9 and 11. From this position it is simple for the hand 2 to move upward to lift the stack off the plate 23 (or the plate 23 can be dropped) and then swung through 90° as it is moved into position over the box 25 as shown in FIG. 6. Once in this position the stack 6 is set down in the box 25, the grabs 9 and 11 are released and, if necessary, a knockout arm 26 holds down the stack 6 while the hand 2 is raised out of the box 25. If the box 25 is much larger than the folded stack 6, they can be set in a predetermined pattern, or if it is the same size the hand 2 can pivot through 180° between successive stacks 6 to orient their folds in opposite directions and make the pile of stacks 6 stable.

Figure 8:
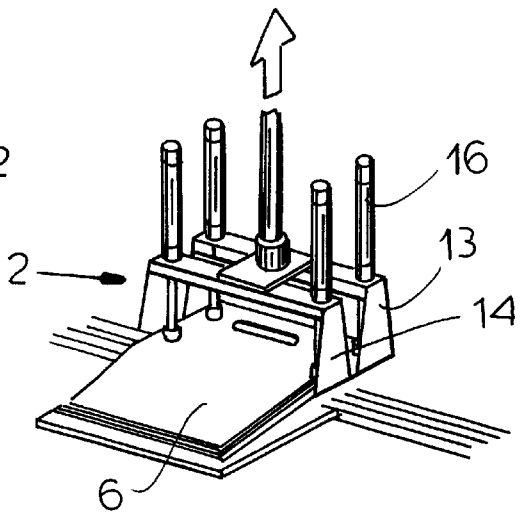
Figure 7:
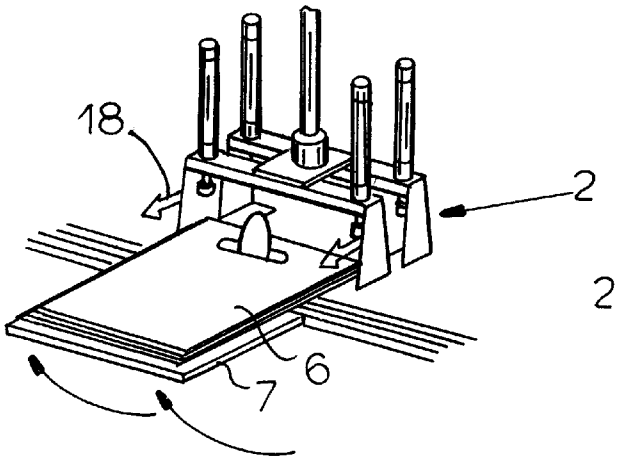

FIGS. 7 and 8 show how the hand 2 moves in to grip and pick up the stack 6 from the stacking station 4. Then, however the hand pivots through somewhat more than 90° as indicated by arrow 27 in FIG. 9 to fold the pendant portion 22 of the stack 22 against the portion 21 held by the grabs 9 and 11, forming the fold without use of any other tools.

Figure 9:
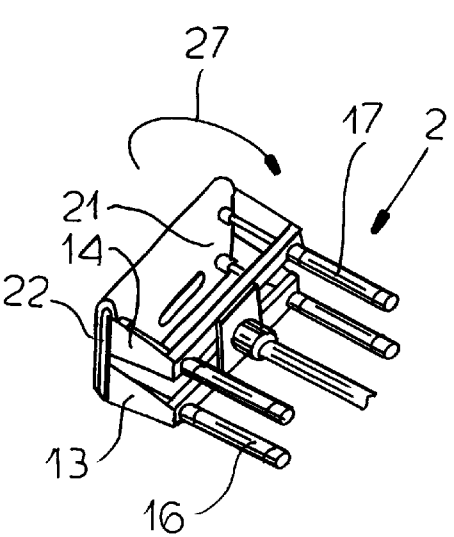
FIGS. 7 through 12 illustrate another method and apparatus in accordance with the invention.
Figure 12:
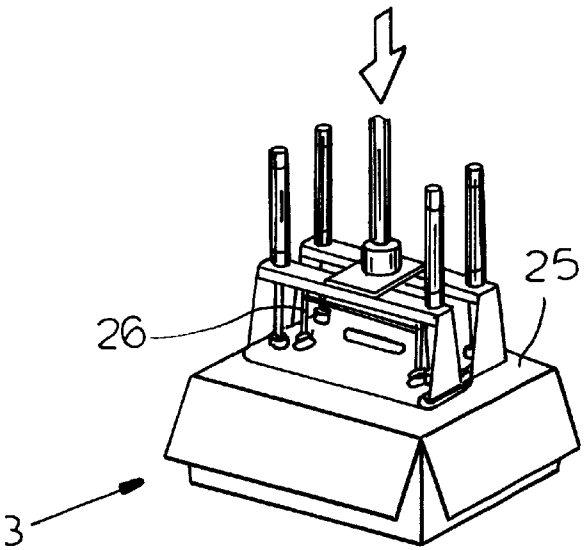
Figure 11:
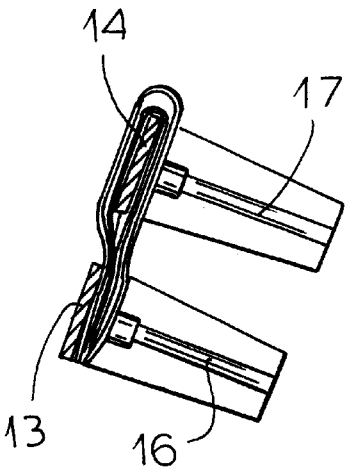

Here the jaws 13 and 14 are provided with an actuator illustrated schematically at 28 that can spread them so that, once the bag is folded over as indicated in FIG. 9, the back grab 9 can be opened by spreading of the outer jaws 13 after the inner jaws 16 have been retracted. Due to the somewhat overturned position of the stack in FIGS. 9 and 10 the pendant portion 22 will come to rest flatly against the held portion 21 which will allow the jaws 13 to move back in outside the pendant portion 21 and, on operation of the inner jaws 16, regrip the folded stack as shown in FIG. 11. Then the entire hand 2 is pivoted back into a horizontal position to deposit the folded and held stack 6 in the box 25 as shown in FIG. 12.

Figure 10:
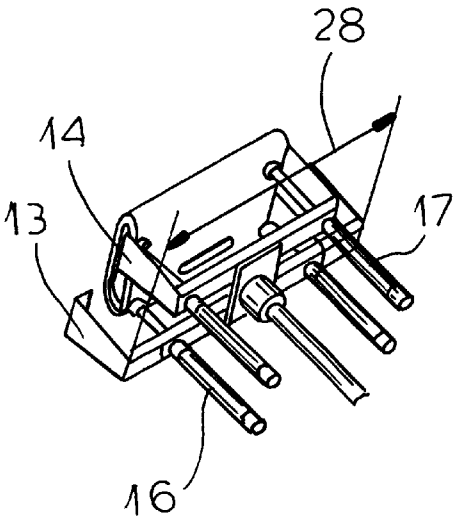
Figure 13:
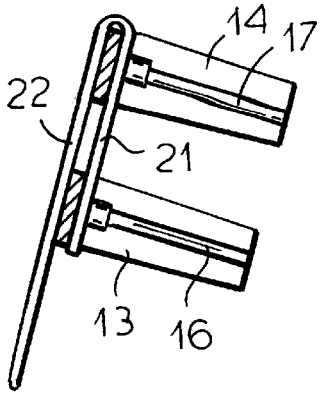
FIGS. 13 through 17 are partly sectional side views illustrating yet another bag-handling system according to the invention.
Figure 14:
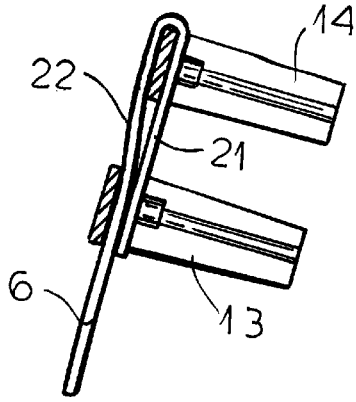
Figure 15:
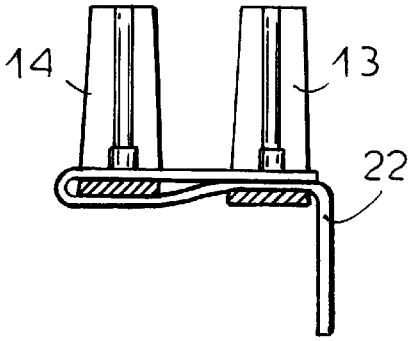
Figure 16:
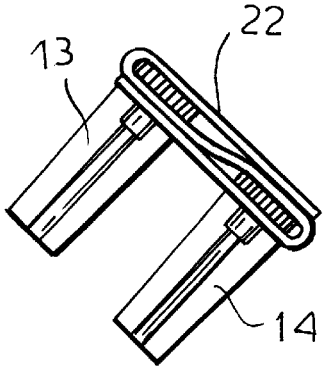
Figure 17:
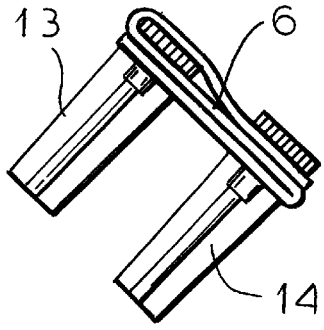

FIGS. 13 and 14 illustrate the clamping action shown in FIGS. 10 and 11. FIGS. 15, 16, and 17 illustrate how by flip-flopping back and forth and opening and closing whichever jaws 13 or 14 are on the bottom, it is possible to form multiple folds in the stack 6. From the FIG. 13 position the hand 2 is moved through about 250° to achieve a second fold, and of course this action could be repeated back and forth to form as many folds in the stack as are desired.

Figure 18:
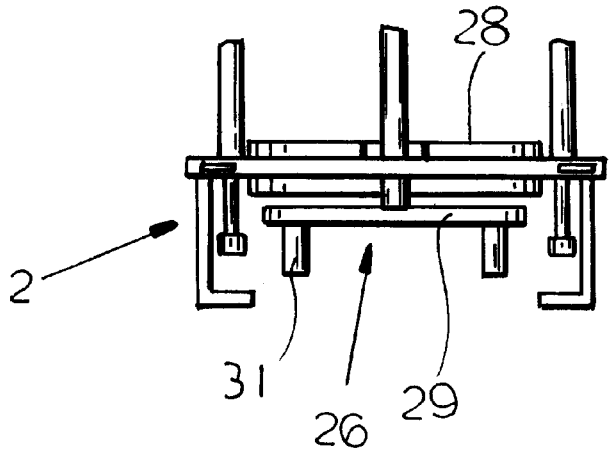
FIG. 18 is an end view of the robot hand used in the systems of FIGS. 7 through 17.

FIG. 18 illustrates the hand 2 with its spreading actuator 28. In addition this system has knockout bolts 31 carried on a frame 29.

Figure 19:
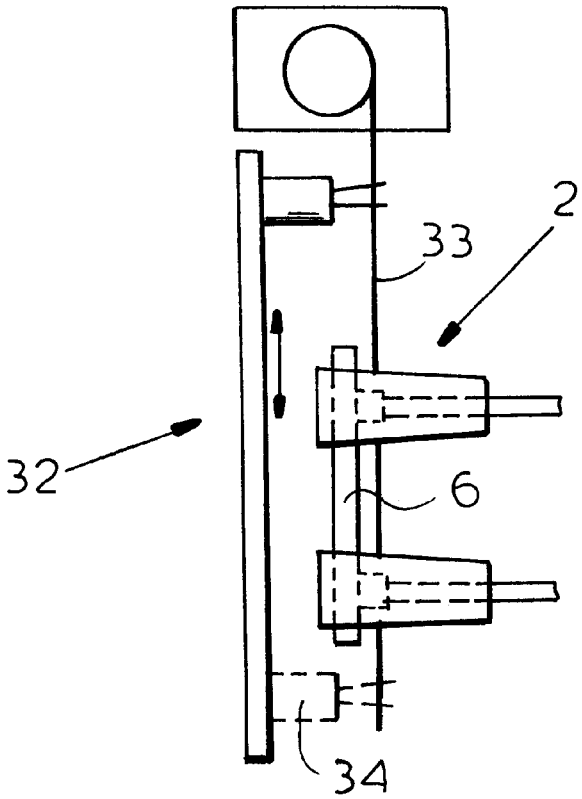
FIG. 19 is a small-scale partly diagrammatic side view of a strapping apparatus in accordance with the invention.

FIG. 19 shows a strapping device 32 which winds a strapping tape 33 around the folded stack 6. A gripper/cutter 34 can cut off a section of the tape 33 and secure its ends together to stabilize the stack 6.

We claim:

1. A method of packaging a stack of flexible bags oriented horizontally in a stack station, the method comprising the steps of sequentially:

a) sliding a robot hand horizontally into position around an end portion of the stack with front and rear grabs of the hand aligned with edges of the end portion and an other portion of the stack wholly outside the hand;

b) closing the grabs on the edges of the end portion with the front grab positioned inward of the stack from the back grab;

c) raising the hand and pivoting it about a horizontal axis to fold the gripped stack about a fold line adjacent the front grab and to one side of which lies the gripped portion and to the other side of which lies the other portion, whereby the bag is given a downwardly open U-shape;

d) releasing the back grab and reengaging it around the folded stack to press the other portion against the end portion still gripped by the front grab;

e) pivoting the hand into a position with the folded and gripped stack oriented horizontally and positioning the folded and gripped stack in an upwardly open container; and f) releasing the grabs and lifting the hand out of the container to leave the folded stack therein.

2. The bag-packaging method defined in claim 1 further comprising after step c) the steps of:

c') setting the folded stack atop a fold plate; and c") releasing the front grab from the folded stack.

3. The bag-packaging method defined in claim 2 further comprising after step c") the step of c'") raising the hand, orienting it with one of the grabs above the other, and then lowering it down over the folded stack on the fold plate.

4. The bag-packaging method defined in claim 1 wherein in step c) the hand is pivoted sufficiently that the other portion comes to lie against the one portion held by the grab, the method comprising after step c) the step of:

c') retracting the front grab from between the portions of the folded stack and reorienting it outside the portions.

5. The bag-packaging method defined in claim 4, further comprising after step c') the steps of:

c") closing the front grab on both portions of the folded bag while leaving an outer portion of the stack hanging from the front grab;

c'") pivoting the hand backward until the outer portion comes to lie against the outer portion of the folded stack;

c"") retracting the rear grab from between the end and other portions and engaging it back against the outer portion to press same against the end and other portions.

6. The bag-packaging method defined in claim 1 wherein during step f) the folded stack is pushed down out of the hand into the container.

7. The bag-packaging method defined in claim 1, further comprising after step e) the step of:

e') wrapping a band around the folded stack.

8. An apparatus for packaging a stack of flexible bags oriented horizontally in a stack station, the apparatus comprising:

a robot hand having front and rear grabs engageable with edges of an end portion of the stack with another portion of the stack wholly outside the hand; and control means for closing the grabs on the edges of the end portion with the front grab positioned inward of the stack from the back grab;

raising the hand and pivoting it about a horizontal axis to fold the gripped stack about a fold line adjacent the front grab and to one side of which lies the gripped portion and to the other side of which lies the other portion, whereby the bag is given a downwardly open U-shape;

releasing the back grab and reengaging it around the folded stack to press the other portion against the end portion still gripped by the front grab;

pivoting the hand into a position with the folded and gripped stack oriented horizontally and positioning the folded and gripped stack in an upwardly open container; and releasing the grabs and lifting the hand out of the container to leave the folded stack therein.

9. The packaging apparatus defined in claim 8 wherein the grabs are each formed by two pairs of jaws, the jaws of the front grab being operable independently of the jaws of the back grab.

10. The packaging apparatus defined in claim 9, further comprising means for displacing one of the pairs of jaws of each grab away from the other of the pairs of jaws of the respective grab.

* * * * *